United States Patent [19]

Hyatt

[11] 4,373,506

[45] Feb. 15, 1983

[54] STOVE WITH CO-AXIAL VENT AND FLUE DESIGN

[76] Inventor: James R. Hyatt, Rte. 1, Box 267-A, Clarkton, N.C. 28433

[21] Appl. No.: 148,187

[22] Filed: May 8, 1980

[51] Int. Cl.[3] ..... F24B 3/00; F24B 7/00

[52] U.S. Cl. ..... 126/67; 126/123; 126/134; 126/312; 126/313; 237/52

[58] Field of Search ..... 126/121, 123, 126, 131, 126/136, 134, 5, 6, 21 A, 31, 313, 61, 67; 165/DIG. 2; 237/51, 52

[56] References Cited

U.S. PATENT DOCUMENTS

| | | | |
|---|---|---|---|
| 67,945 | 8/1867 | Bowman | 126/313 |
| 81,236 | 8/1868 | Wolf | 126/313 |
| 564,817 | 7/1896 | Barrier | 126/61 |
| 2,471,351 | 5/1949 | Russell | 237/51 |
| 3,952,721 | 4/1976 | Patterson | 126/126 X |
| 4,173,966 | 11/1979 | Scharen | 126/121 |

*Primary Examiner*—Larry Jones
*Attorney, Agent, or Firm*—Mills and Coats

[57] ABSTRACT

The present invention relates to a stove of the type having a firebox and a second outer wall that defines an air passageway around the fire-box. Provided with the stove is a fan for forcing air around the defined air passageway for collecting heat from a burning fire within the firebox. A flue is communicatively connected with the firebox and extends therefrom through the defined air passageway and on through the outer wall structure of the stove. Co-axially disposed around the flue and communicatively connected with the air passageway is a vent for directing heated air from the stove. The co-axial relationship of the vent and flue assures that the flue gases must pass within the heated air passing in the vent or vice versa, and this gives rise to a very efficient stove inasmuch as a substantial portion of the heat associated with the flue gases being exhausted is transferred to the vented air.

2 Claims, 2 Drawing Figures

STOVE WITH CO-AXIAL VENT AND FLUE DESIGN

FIELD OF INVENTION

The present invention relates to heaters and stoves and to the type of heaters and stoves that are adapted to burn material such as wood, coal and the like and which are of a double wall construction and provided with fan means for forcing air between the double wall construction. More particularly, the present invention relates to a freestanding stove or heater that is adapted to heat a relatively large building and accordingly is provided with means for transferring the heated air from the stove to various areas within the structure.

BACKGROUND OF INVENTION

In the past few years, almost everyone has become aware of the energy crisis because of the increases in price of fuel and electricity and the scarcity of such. Fuel oil alone in the past years has risen in price quite dramatically and the cost of heating a dwelling or structure has in some cases more than doubled in this period of time.

In view of this, over the past three years especially, there has been a great deal of activity in stoves and heaters of the type designed to burn wood, coal or the like. Individuals are finding now that wood, for example, is a practical source of fuel for heating a home and in many cases is more economical than other forms of fuel.

In reviewing these types of stoves, one finds that there are basically two types of designs. First, there is the freestanding stove and secondly, there is what is now being referred to as a fireplace stove insert.

With all this activity in stoves and heaters, there has been a substantial effort to provide more efficient designs. In reviewing stoves presently available, one finds that some stoves are more efficient than others and that some stoves are more suited to particular applications than others. But there is still many shortcomings and disadvantages in stoves commercially available today.

The principal shortcoming and disadvantage of present day stoves lies in the generally low overall efficiency found in such. While as pointed out above, there have been improvements in some stove designs, many are designed to heat a relatively small area as contrasted to an entire dwelling or structure.

Also, another shortcoming of conventional stove designs is the fact that a substantial amount of the heat is lost through the exhausted flue gases.

SUMMARY OF INVENTION

The present invention entails a stove or heater that is designed to heat a relatively large structure and which is designed to improve the overall efficiency of conventional stoves.

In particular, the stove or heater of the present invention is of the type having a double wall construction that gives rise to a central firebox and an air channeling area therearound whereby the provision of fan means air is circulated around the firebox so as to receive heat resulting from a fire within the firebox. To more efficiently take advantage of the heat produced in the firebox, the stove of the present invention is provided with a flue structure that extends in co-axial relationship from the stove with vent means that directs heated air from the air channeling air around the firebox. This co-axial relationship between the vent and flue serves to capture a substantial portion of the heat associated with the exiting flue gases.

In addition, the stove of the present invention is designed such that the vent extending from the stove and carrying the heated air can be directed to various areas within a relatively large structure for heating these areas.

It is, therefore, an object of the present invention to provide an efficient heater or stove for burning fuel such as wood, coal or the like.

Still a further object of the present invention resides in the provision of a heater that is designed to effectively and efficiently transfer heat from the firebox to a passing system of air and to direct this heated air to numerous areas within a relatively large structure where the heated air is dispersed for uniformly heating these areas.

A very important object of the present invention is to increase the overall efficiency of a stove or heater of the character referred to above by effectively capturing more heat from the exhaust gases being expelled from the firebox through the flue.

Another object of the present invention resides in the provision of a stove or heater of the character referred to above wherein the stove is of a basic double wall construction with an internal firebox and means for circulating a system of air exteriorly therearound and wherein the above is provided with an exhaust vent for exhausting heated air and a flue for exhausting flue gases from the firebox wherein the exhaust vent and flue extend in co-axial relationship from the stove so as to effectively transfer a substantial portion of the heat associated with the flue gases even after leaving the basic stove structure.

Another object of the present invention resides in the provision of a stove or heater of the character referred to above that is easily adapted to numerous heating applications, and which is relatively simple and inexpensive but which is durable and easy to maintain.

It is also a further object of the present invention to provide a stove or heater of the character referred to above that is provided with efficient humidifier means for adding moisture to the heated air prior to being expelled from the stove.

Other objects and advantages of the present invention will become apparent from a study of the following description and the accompanying drawings which are merely illustrative of the present invention.

THE STOVE OF THE PRESENT INVENTION

Figure 1:
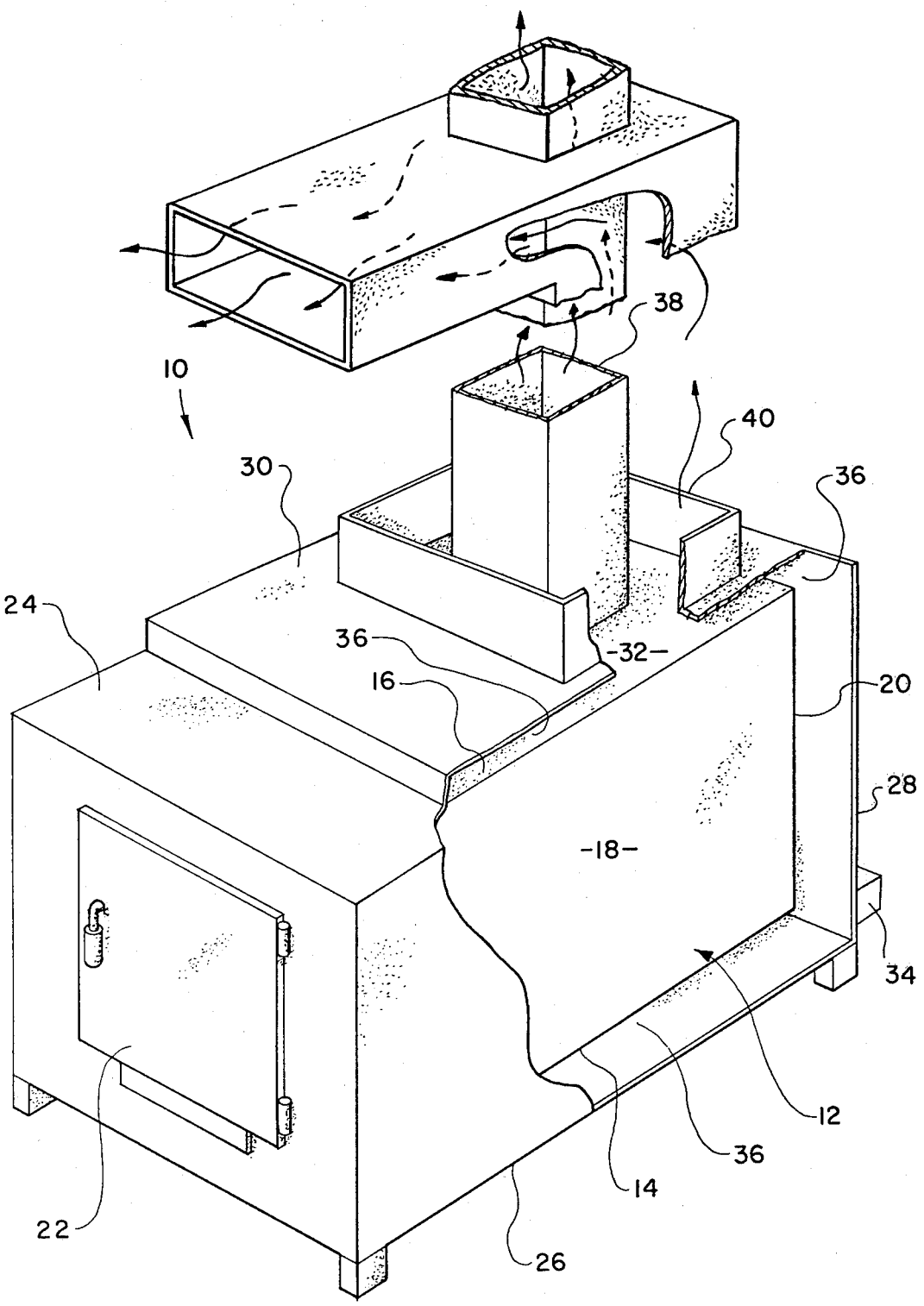
FIG. 1 is a perspective view of the stove of the present invention with portions broken away to better illustrate the internal structure thereof.
Figure 2:
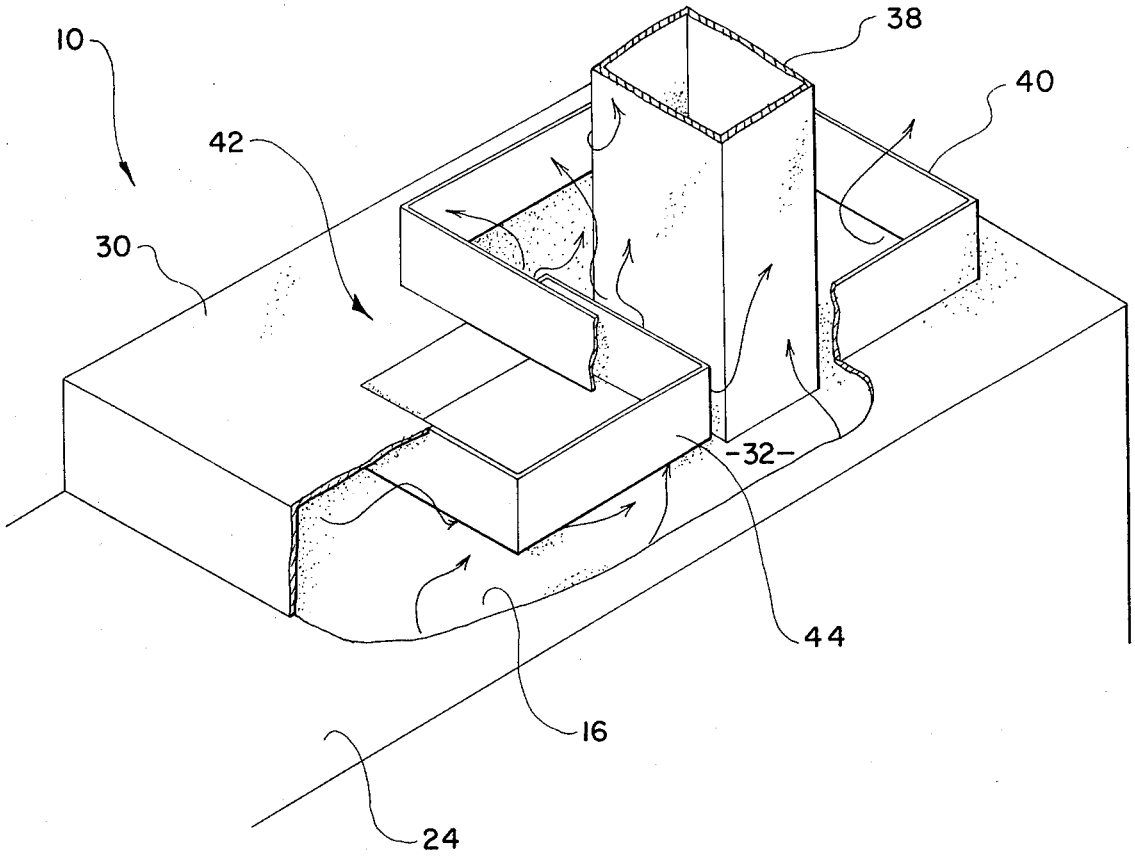
FIG. 2 is a fragmentary view illustrating a humidifier incorporated into the stove of the present invention.

With further reference to the drawings, the stove of the present invention is shown therein and indicated generally by the numeral 10.

Viewing stove 10 in more detail, it is seen that the same includes a central firebox indicated generally by the numeral 12 which is comprised of a bottom 14, top 16, sides 18, back 20 and a swingable front access opening door 22.

Also in the particular design of the present stove, the front top portion of the stove includes a cooking top 24 that also forms the top of firebox 12.

Surrounding a substantial area of the firebox 12 including top, sides, back and bottom, is an outer wall structure that includes a bottom 26, back 28, top 30 and a pair of sides 32. In effect this outer wall in conjunction with the firebox wall structure forms a double wall construction that defines an air passageway for air channeling area 36 between firebox 12 and the outer wall structure just described.

Communicatively connected to the air passageway 36 and mounted about the back of the stove disclosed herein is fan means 34 for generating a system of air and forcing the air through the air passageway or air channeling area 36. It follows that where a fire is being maintained within firebox 12 that the circulating system of air through the air passageway receives heat transferred from the firebox 12.

Communicatively connected to the top of firebox 12 and extending therefrom through the air passageway 36 is a flue 38. Flue 38 enables the combustion gases to be exhausted from the firebox.

Also provided with stove 10 is a vent 40 that is communicatively connected with the air passageway 36 for directing heated air from the air passageway 36. Of importance in this case is the design relationship between vent 40 and flue 38. As shown in the drawings, it is seen that flue 38 extends within vent 40. This allows continuing heat exchange between the flue gases and the vented heated air for a period of time after the heated air has actually departed the air passageway 36 surrounding firebox 12. Because there is substantial heat within the flue gases, this means that the overall efficiency of the stove is increased.

The important consideration in this regard is the structural relationship of the flue 38 and vent 40. In the disclosure shown herein, the vent 40 and flue 38 are in co-axial relationship, meaning that the gas or air being transferred in one is in fact being transferred interiorly of the other.

Stove 10 of the present invention is specifically designed for high capacity and to heat a relatively large structure. Consequently, vent 40 could extend a substantial distance even up to six feet in some cases adjacent flue 38. After so extending, vent 40 will then separate from its coaxial relationship with flue 38 and be directed to various areas within a large structure for heating these areas.

Finally, stove 10 includes humidifying means indicated generally by the numeral 42 for adding moisture to the heated air being circulated through air passageway or air channeling areas 36. Humidifying means 42 includes a water container 44 that as shown in the drawings is oriented generally transversely to the path of air flow within the respective area of the air passageway 36. In addition, container 44 is vertically spaced so as to constrain the passing air to passing thereunder after which the air may turn approximately ninety degrees and move upwardly adjacent one side thereof. It is also seen in the drawings that as the air moves upwardly adjacent the end or side of the container 44 that the adjacent open top portion due to the construction design shown in the drawings is operative to allow water held in the container 44 to vaporize into the passing air. Hence, moisture is added to the heated air prior to being exhausted through vent 40.

The terms "upper," "lower," "forward," "rearward," etc., have been used herein merely for the convenience of the foregoing specification and in the appended claims to describe the stove and its parts as oriented in the drawings. It is to be understood, however, that these terms are in no way limiting to the invention since the stove may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A forced air stove having a unique co-axial flue and vent design for effectively capturing heat around the firebox and the flue extending therefrom, comprising: a rectangular firebox having a surrounding wall including a generally horizontal top structure and adapted to receive and burn combustible fuel material such as wood and coal therein; access door means operatively associated with said firebox for gaining access thereto; an outer wall structure disposed outwardly of the wall structure of said firebox over a substantial area of said firebox for defining an air passageway therebetween where the defined air passageway acts to channel air around the firebox when material is being burned therein such that the heat from the material being burned may be transferred to the passing air; said outer wall structure having a top including a horizontally disposed top portion that extends generally parallel to said top of said firebox; fan means operatively associated with said stove and communicatively connected with said defined air passageway for generating a system of air and forcing the same through said air passageway; flue means communicatively connected to the top of said firebox and extending therefrom through the air passageway defined exteriorly of said firebox and on through the plane of the top portion of said outer wall structure overlying the top of said firebox wherein flue gases resulting from the combustion within the firebox may pass therethrough; a vent opening formed in the top portion of said outer wall structure around the upwardly extending flue; vent means disposed outwardly of and around said flue and communicatively connected to the vent opening and said air passageway and connected to and extending from the top portion of the outer wall structure in co-axial relationship with said flue means such that heat being exhausted by said flue means must pass in close heat exchange relationship with flue gases passing from said firebox through said flue means, and wherein said co-axial relationship between said flue means and said vent means assures that the air passing through one must pass within the other although in separate relationship; humidifier means operatively associated with said stove and generally disposed in association with said defined air passageway for transferring moisture to the heated air passing therethrough, said humidifier means including a water container disposed within said defined air passageway in the path of the passing air wherein the water container acts to transfer moisture to the passing heated air and wherein said water container is oriented transverse to the general direction of air flow within said defined air passageway and vertically spaced over the passing air flow such that the passing air flow is constrained to pass thereunder after which the air flow may turn approximately 90 degrees and move up one side of the water container and on up adjacent the open top thereof.

2. The stove of claim 1 wherein said vent means extends substantially adjacent said flue means in co-axial relationship; and wherein said vent means then departs from said flue means and extends separately therefrom to form a heat transfer duct for transferring heat to various areas within a structure.

* * * * *